US005503575A

United States Patent [19]

Ciampini

[11] Patent Number: 5,503,575

[45] Date of Patent: Apr. 2, 1996

[54] ELECTRICAL CONNECTOR ASSEMBLY

[76] Inventor: Harold E. Ciampini, 7853 Petersen Point Rd., Milton, Fla. 32583

[21] Appl. No.: 254,902

[22] Filed: Jun. 6, 1994

[51] Int. Cl.[6] ..... H01R 4/50

[52] U.S. Cl. ..... 439/863; 439/783

[58] Field of Search ..... 439/863, 791, 439/794, 725, 803, 772, 775, 783, 796

[56] References Cited

U.S. PATENT DOCUMENTS

| | | | |
|---|---|---|---|
| 1,001,054 | 8/1911 | Lawrence . | |
| 1,597,169 | 8/1926 | Taylor . | |
| 2,750,478 | 6/1956 | Field | 439/863 |
| 2,920,305 | 1/1960 | Evans | 439/814 |
| 3,012,089 | 12/1961 | Ridgers . | |
| 3,374,456 | 3/1968 | Evans | 439/814 |
| 3,500,296 | 3/1970 | O'Keefe et al. . | |
| 4,156,793 | 5/1979 | Carlson . | |
| 4,162,819 | 7/1979 | Eisert | 439/863 |
| 4,684,204 | 8/1987 | Johnson et al. | 439/863 |
| 4,768,963 | 9/1988 | Barron | 439/814 |
| 4,781,619 | 11/1988 | Ikeda . | |
| 5,244,424 | 9/1993 | Hessey | 439/863 |

FOREIGN PATENT DOCUMENTS

| | | |
|---|---|---|
| 2634327 | 1/1990 | France . |

*Primary Examiner*—David L. Pirlot

[57] ABSTRACT

An electrical connector particularly adapted for connecting the free end of a conductor to a grounded rod. The connector comprises an elongated electrically conductive body having first and second opposite ends connected by a longitudinal axis. A first axial recess in the first end extends along the longitudinal axis partially through the body. A transverse recess extends through the body communicating with the first axial recess. The conductor free end is placed in the transverse recess. The lower end of a plug is placed in the first axial recess and fits snugly in the first axial recess with the lower end contacting and compressing the conductor end extending into the transverse recess. The lower end of the body contains a similar recess for receiving the upper end of a grounding rod.

4 Claims, 1 Drawing Sheet

ELECTRICAL CONNECTOR ASSEMBLY

The invention relates to the art of electrical connectors, and more particularly to such connectors used to ground a conductor.

Many connector designs have been used to ground a conductor. Frequently these prior designs tended to become loose, required special tools for installation, or were expensive.

These and other problems with prior art designs are avoided by the present invention, which provides a simple, inexpensive, and reliable solution to the problem.

According to a first principal aspect of the invention there is provided an electrical connector for coupling to an electrical conductor having a free end, the connector comprising in combination an elongated electrically conductive body having an outer wall and first and second opposite ends, the body further having a longitudinal axis connecting the first and the second ends. A first axial recess resides in the first end, together with a transverse recess in the body for receiving the free end of the conductor, the transverse recess communicating with the first axial recess in a lower region thereof. Plug means are provided having a lower end and an upper free end, the lower end fitting snugly in the first axial recess and contacting and compressing the conductor in the overlap region.

According to another aspect of the invention, both the first axial recess and the transverse recess are circular in cross section, and the conductor substantially fills the transverse recess.

According to another aspect of the invention, means are provided defining a second axial recess extending from the second end along the longitudinal axis partially through the body.

According to another aspect of the invention, at least one of the first recess and the first plug means tapers from a larger diameter at a location remote from the conductor end to a smaller diameter in the vicinity of the conductor end.

According to another aspect of the invention, the first plug means comprises indicia means for indicating when the first plug means is fully seated in the first recess.

Other aspects will in part appear hereinafter and will in part be apparent from the following detailed description taken together with the accompanying drawings, wherein.

Figure 1:
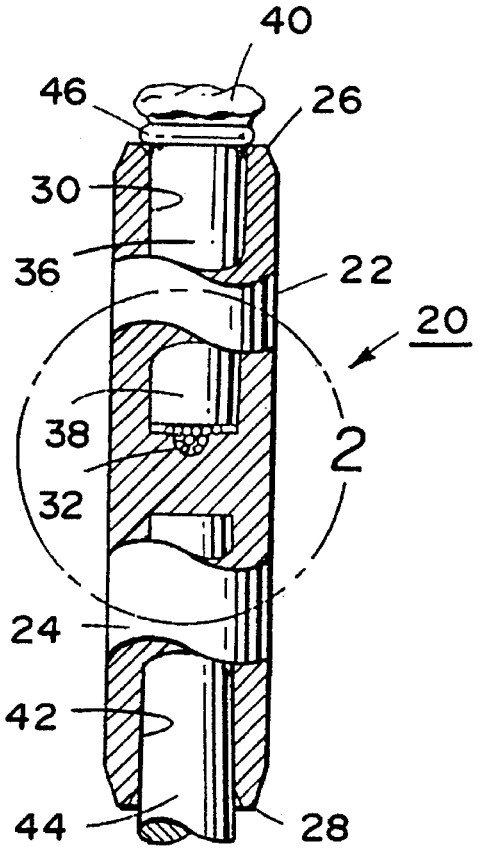
FIG. 1 is a side elevational view, partly broken away, of a first preferred embodiment of the invention.

With reference to FIG. 1, connector 20 comprises elongated electrically conductive body 22 having outer wall 24 and first and second opposite ends 26 and 28 respectively. Body 22 has a longitudinal axis extending between end 26 and end 28. Walls define first axial recess 30 in first end 28. Recess 30 extends downwardly along the axis of body 22 partially through body 22. In the illustrated FIG. 1 embodiment, body 22 has a circular cross-section. Recess 30 also has a circular cross-section and extends nearly half way down the length of body 22 from first end 26 toward second end 28. Walls define transverse recess 32 in body 22 for receiving the free end of conductor 34. Recess 32 preferably extends entirely through body 22, and overlaps and communicates with recess 30 in an overlap region.

Plug means 36 preferably has a circular cross-section, and has lower end 38 and upper free end 40. Lower end 38 fits snugly in axial recess 30 with an interference or force fit, being installed by blows by a hammer, for example.

Second end 28 of body 22 has walls defining recess 42 extending upwardly along the body axis partially through body 22. Plug 44, which may be the upper end of a grounding rod, fits in recess 42 with an interference fit, similar to that of plug 36 in recess 30.

To install connector 20, the free end of conductor 34 is passed into (preferably entirely through) transverse passage 32. Best results are obtained when conductor 34 substantially fills recess 32 so that a relatively large amount of conductor 34 lies in the overlap region common to recesses 30 and 32. Conductor 22 is next assembled with plugs 36 and 44. Free end 40 is then forced downward (as by tapping with a hammer) until lower end 38 enters the overlap region and contacts and deforms the upper surface of conductor 34. This insures a positive electrical connection.

In order to determine when plug 36 has been inserted sufficiently deeply into recess 30, indicia means are provided for indicating when plug 36 is fully seated. Such indicia means can be, as illustrated, raised ring 46 integrally formed on plug 36. Ring 46 is positioned on plug 36 such that ring 46 aligns with first end 26 when plug 36 is properly seated in recess 30.

Preferably, at least one of recess 30 and plug 36 is tapered from a larger diameter at a location remote from conductor 34 to a smaller diameter in the vicinity of conductor 34. A taper of about 1 degree is preferred.

Figure 3:
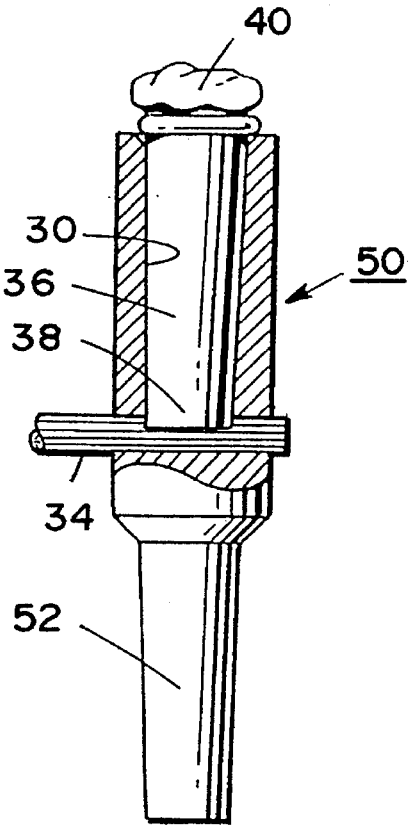
FIG. 3 is a side elevational view of a second preferred embodiment of the invention.
Figure 2:
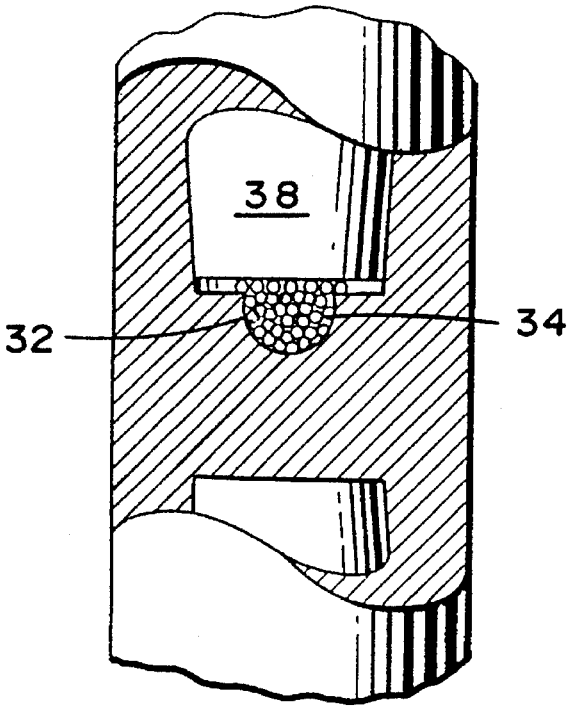
FIG. 2 is an enlarged view of the central portion of the FIG. 1 embodiment indicated by the dashed circle therein.
Figure 4:
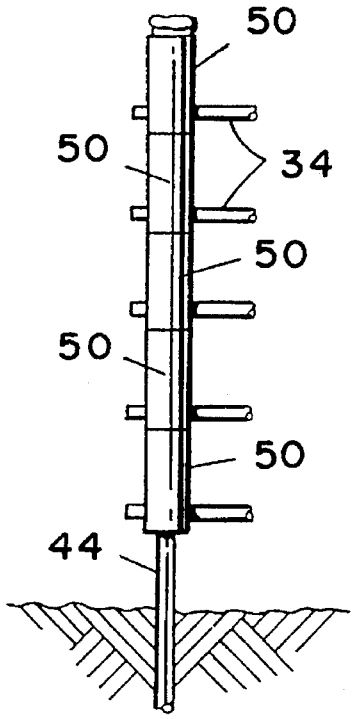
FIG. 4 is a schematic side elevational view of several of the FIG. 3 embodiments installed together.

The second preferred embodiment of the invention is illustrated in FIGS. 3 and 4. The upper portion of the connector 50 is identical to that disclosed above with respect to connector 20 and accordingly will not be described again except to note that corresponding parts bear the same reference numbers in the several figures. Lower portion 52 of plug 50 is formed to substantially the same shape and size as plug 36, facilitating stacking of several connectors 50 to use a single grounding rod 44, as illustrated in FIG. 4. Note that the lowermost connector in FIG. 4 is the FIG. 1 type, while the remainder are of the FIG. 3 type. This eliminates extra plugs fitting in adjacent recesses that would be required if only the FIG. 1 type were used.

I claim:

1. An electrical connector assembly for coupling electrical conductors, said connector assembly comprising in combination:

(a) an elongated electrically conductive body having an outer wall and first and second opposite ends, said body further having a longitudinal axis connecting said first and said second ends;

(b) a first axial recess in said first end, said first axial recess extending along said longitudinal axis and partially through said body, said first axial recess having a longitudinal cross section which decreases from said first end of said conductive body to the bottom of said first axial recess;

(c) a transverse recess in said body for receiving a free end of a conductor to be coupled to said conductive body, said transverse recess normal with and intersecting said first axial recess adjacent the bottom of said axial recess;

(d) conical plug means having a lower end and an upper end, said lower end adapted to be snugly received by said first axial recess and extending into said axial recess to an extent sufficient to contact and deform said free end of said conductor passing through said transverse recess and extending into said axial recess; and (e) a second axial recess in said second end of said electrically conductive body, said second axial recess extending along said longitudinal axis and partially through said body and adapted to receive a conical end portion of a grounding rod.

2. The assembly defined in claim 1, wherein both said first axial recess and said transverse recess are circular in cross section, and wherein said conductor substantially fills said transverse recess.

3. The assembly defined in claim 1, wherein the longitudinal cross section of said first axial recess decreases from said first end of said conductive body to the bottom of said first axial recess.

4. The assembly defined in claim 1, wherein said first plug means includes a ring formed thereon which, when aligned with said first end, indicates when said first plug means is fully seated in said first recess.

* * * * *